United States Patent [19]

Fitte

[11] 4,179,044

[45] Dec. 18, 1979

[54] CLOSURE CAP FOR POURING OR DISPENSING TOPS OF BOTTLES OR SIMILAR RECEPTACLES

[75] Inventor: Daniel Fitte, Paris, France

[73] Assignee: Rical, S.A., Longnvic, France

[21] Appl. No.: 881,673

[22] Filed: Feb. 27, 1978

[30] Foreign Application Priority Data

Feb. 28, 1977 [FR] France ..... 77 05794

[51] Int. Cl.[2] ..... B65D 41/06

[52] U.S. Cl. ..... 222/551; 215/318

[58] Field of Search ..... 222/498, 551, 541; 215/318; 220/293, 296, 298

[56] References Cited

U.S. PATENT DOCUMENTS 3,741,423 6/1973 Acton et al. ..... 215/318 X 3,822,027 7/1974 Cherba ..... 215/9

FOREIGN PATENT DOCUMENTS 2357432 7/1976 France ..... 215/318

*Primary Examiner*—Stanley H. Tollberg

*Attorney, Agent, or Firm*—Stevens, Davis, Miller & Mosher

[57] ABSTRACT

This is a combination pouring spout and closure cap which straddles the same. The closure cap has two annular dependent spaced skirts. The inner of these skirts fits tightly the inner space of the pouring spout and is held in position by coaction of circumferentially spaced helicoidal ridges on the inner face of the outer skirt with an interrupted ridge on the outer face of the pouring spout.

4 Claims, 2 Drawing Figures

CLOSURE CAP FOR POURING OR DISPENSING TOPS OF BOTTLES OR SIMILAR RECEPTACLES

Closure caps for pouring or dispensing tops are already known which have an inner sealing joint adapted to contact, along an inner, preferably conical portion, the pouring edge provided on tops of this type, said caps preferably coming to rest on a shoulder of said pouring tops provided on these tops at the level of a peripheral portion which rests on the upper edge of the neck of a bottle or similar receptacle, and which furthermore may be provided, on their outer skirt, with an inner boss provided to assure the retention of these caps by cooperation with the lower portion of the outer edge of a ditch surrounding the outer portion of said pouring edge.

The object of the present invention is an improvement in said caps directed at improving their tightness after the tearing of the hermetic membrane of said pouring tops when they are placed in use, this improvement consisting in imparting to the peripheral annular portion of said caps which is located between the outer and inner skirts of said caps, a sufficient thickness to permit the inner face thereof to apply itself, in the low position of said caps, against the substantially horizontal upper portion of the said pouring edge, thus assuring a second hermetic annular zone.

Another important improvement in accordance with the present invention is the provision on said caps of internal ribs of slight thickness having the shape of helicoidal ramps which make it possible to introduce said caps by a simple vertical push causing said internal ribs to pass in their entirety below a peripheral rim provided for this purpose on the outer portion of the said pouring tops but permitting the disengagement of said caps only by turning said caps until the upper portion of said inner ribs arrives opposite preferably equally spaced interruptions provided in the said peripheral rim in a number equal to the number of said inner ribs and, upon the continuation of this movement of rotation makes it possible completely to free the said caps from the said pouring tops.

Figure 1:
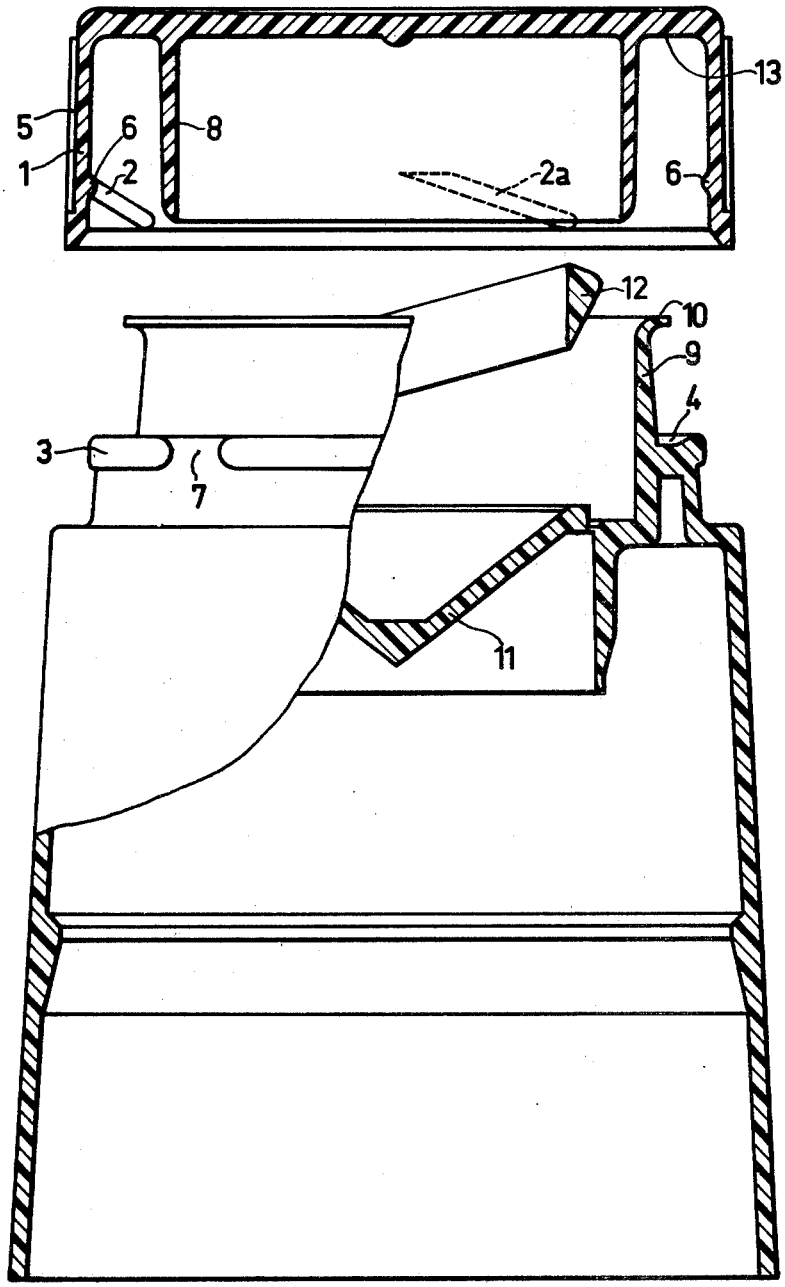
Figure 2:
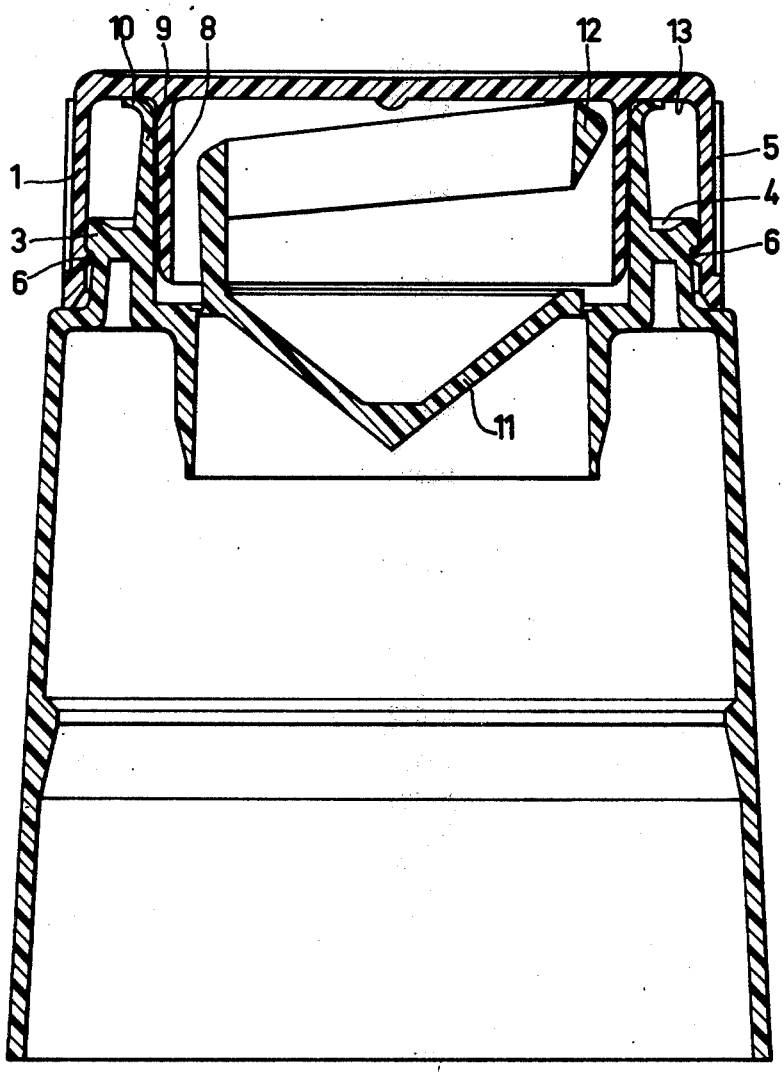

The characteristic features of the present invention will be better understood from a reading of the following description of one embodiment of the cap of the present invention, which embodiment is given solely by way of illustration and not of limitation and is described with reference to the accompanying drawing in which FIG. 1 is a view in diametral section of said cap, showing the inner ribs in the shape of helicoidal ramps provided on the inside of said cap and the manner in which these ramps cooperate with the said rim which is provided on the peripheral portion of a pouring top; and FIG. 2 is a view in diametral section of the said pouring top and cap after said cap has been mounted on said top.

In accordance with FIG. 1, outer skirt 1 of the said cap has internal ribs 2 and 2*a* in the shape of helicoidal ramps, said cap having a third similar helicoidal ramp, not visible in FIG. 1, located in front of the sectional plane of said cap.

It can easily be understood that by pushing the cap vertically onto the pouring top, these helicoidal ribs whose lower ends are rounded can pass below the peripheral rim 3 which surrounds a recess 4 provided below the upper edge of said pouring top, the upper portion of said rim being also rounded.

The lower end of the said ramps could also be provided for this purpose with a bevel which facilitates this movement and replaces the roundings which have been mentioned above.

On the other hand in order to disengage the cap from the said pouring top it is necessary to turn said cap, which is knurled externally at 5, until the upper portions 6 of the three helicoidal ribs 2, 2*a* arrive opposite the interruptions 7 provided on the peripheral rim 3, the continuation of this movement of rotation permitting said ribs to pass completely above the said peripheral rim.

Of course, the thickness of the upper portion of the said ribs remains constant up to its extreme edge located in a horizontal plane, and the lower portion of the said peripheral rim cooperates with this extreme edge on an inner annular surface which is also horizontal.

In FIG. 2 it is seen that the inner sealing skirt 8 of the cap not only applies itself tightly via its outer portion against the inner portions 9, slightly conical in profile, of the said pouring stopper, but that the inner annular portion located between the outer and inner skirts of said cap also applies itself against the upper portion 10 of the pouring edge of said top, so that after the tearing of the hermetic membrane 11 by means of a gripping ring 12 upon the placing in use of the bottle on which said top is mounted, the liquid contained in said bottle connot pass into the space separating the pouring edge 9, 10 from the outer portion of the inner sealing skirt 8 of said cap and from the inner portion of the annular space 13 located between the inner and outer skirts of said cap.

In the sectional view shown in FIG. 2 it can be noted furthermore that the upper portion 6 of the helicoidal ribs 2, 2*a* is located below the peripheral bead 3 surrounding the recess 4 so that said upper end comes into abutment against the lower portion of the said peripheral rim 3 and can pass beyond said bead, freeing the cap, only after these upper portions 6 reach the position of the interruptions 7 separating the different portions of the peripheral bead 3.

Of course, various changes, improvements, or additions may be made in the embodiment which has been described, and certain parts may be replaced by equivalent parts without thereby going beyond the general scope of the invention.

I claim:

1. Assembly consisting of a pouring top at the upper portion of a bottle neck and a closure cap having an outer skirt for said top, in which said cap is provided, on the inside, at the lower portion of its outer skirt with helicoidal ribs defined by disposed ribs of a small but constant width spaced apart and having a height component far greater than their width, said pouring top being provided with a peripheral rim having mutually spaced interruptions in number equal to the number of said helicoidal ribs, said ribs and said rim being of similar thickness in order that simple vertical pressure will cause, said ribs to pass in their entirety below said peripheral rim, the upper end of said helicoidal ribs being profiled in such a manner as to permit the lifting of said cap only after arcuate movement of said cap to register the upper end of said helicoidal ribs with said interruptions provided in said peripheral rim and so, by continuation of the arcuate movement to cause said ribs to pass through said interruptions to separate said cap from said top.

2. Assembly according to claim 1, wherein the lower end of said helicoidal ribs and the upper portion of said peripheral rim are rounded.

3. Assembly according to claim 2, wherein the lower end of said helicoidal ribs and the upper portion of said peripheral rim are beveled.

4. Assembly according to claim 1, wherein the upper end of said helicoidal ribs is formed of a sharp-angle horizontal edge which comes against said lower peripheral rim portion when said upper end is not aligned with said interruption.

* * * * *